US008292456B2

(12) United States Patent
Kong

(10) Patent No.: US 8,292,456 B2
(45) Date of Patent: Oct. 23, 2012

(54) LIGHTING FIXTURE WITH ADJUSTABLE LIGHT PATTERN AND FOLDABLE HOUSE STRUCTURE

(76) Inventor: Qin Kong, San Diego, CA (US)

( * ) Notice: Subject to any disclaimer, the term of this patent is extended or adjusted under 35 U.S.C. 154(b) by 0 days.

(21) Appl. No.: 13/373,506

(22) Filed: Nov. 14, 2011

(65) Prior Publication Data

US 2012/0063140 A1 Mar. 15, 2012

Related U.S. Application Data

(62) Division of application No. 12/387,698, filed on May 5, 2009.

(51) Int. Cl.
*F21V 21/00* (2006.01)

(52) U.S. Cl. ..... 362/217.1; 362/217.05; 362/217.08; 362/217.09; 362/217.11; 362/225

(58) Field of Classification Search ..... 362/217.05–217.08, 255, 319–320, 362/217.1–217.17, 225, 217.09
See application file for complete search history.

(56) References Cited

U.S. PATENT DOCUMENTS 4,454,569 A * 6/1984 Maguire ..... 362/127
6,893,139 B2 * 5/2005 Cercone et al. ..... 362/147

* cited by examiner

*Primary Examiner* — Robert May
(74) *Attorney, Agent, or Firm* — Raymond Y. Chan; David and Raymond Patent Firm

(57) ABSTRACT

A lighting fixture includes a reflector reflecting light from a fluorescent lamp to a desired direction, and one or more lamp connectors connecting the reflector to rotatably and detachably coupling with the fluorescent lamp, wherein the reflector is adapted to selectively rotate with respect to an axis of the fluorescent lamp for reflecting light from the fluorescent lamp so as to change a light pattern of the fluorescent lamp towards an opening of the foldable housing. The foldable housing includes two side frames and a retention frame extended between the two side frames to retain a distance therebetween, wherein the side frames are pivotally coupled with the retention frame to fold between an unfolded position to retain the fluorescent lamp in longitudinal position and a folded position to form a compact size for storage and transportation.

14 Claims, 12 Drawing Sheets

LIGHTING FIXTURE WITH ADJUSTABLE LIGHT PATTERN AND FOLDABLE HOUSE STRUCTURE

CROSS REFERENCE OF RELATED APPLICATION

This is a divisional application that claims the benefit of priority under 35 U.S.C. §119 to a non-provisional application, application Ser. No. 12/387,698, filed May 5, 2009, which is a non-provisional application of a provisional application, having an application Ser. No. 12/090,054 and a filing date of Mar. 3, 2009.

BACKGROUND OF THE PRESENT INVENTION

1. Field of Invention

The present invention relates to a lighting luminaire and more particularly to a lighting fixture with a rotatable reflector to adjust the light pattern and a foldable house structure adapted to be unfolded to form a compact size for storage and transportation.

2. Description of Related Arts

The fluorescent luminaries are commonly used in a lot of area. Typically, they are suspended or fixed on the ceiling. FIG. 12 shows the prior art of a typical fluorescent lamp luminaire. The reflector 5 is fixed on a reflector support 7. The reflector support 7 is fixed on a housing 8. The reflector 5 can not be adjusted after installed on the housing 8. Therefore, the light pattern is fixed by the manufactory. The U.S. Pat. No. D520,173S disclosed a fluorescent luminaire with fixed light pattern. In a lot of applications, it is preferred to adjust the light pattern to high light the desired subject. Therefore the typical fluorescent lamp luminaire is not suitable for this kind of applications.

U.S. Pat. No. 6,206,548 B1 disclosed a light fixture with rotatable mirror which is mounted to the housing. It has limited light pattern adjustment and it is not very efficient.

U.S. Pat. No. 5,550,725 disclosed a light fixture with a rotatable reflector. The reflector rotates along with the lamp axis. The direction of the light can be adjusted. However, the width of the light beam can not be adjusted. The system is also very complex, and costly to fabricate.

U.S. Pat. No. 6,450,668 B1 disclosed a light fixture with a foldable structure. It can only change the light direction. It cannot change the light pattern. The folding structure did not save much space. It is still very bulky to handle.

Some of the light fixture has the capability to adjust the light pattern or the direction of the light by rotating the lamp with or without the reflector or moving the lamp with the reflector. They are also very inconvenient to use.

SUMMARY OF THE PRESENT INVENTION

The main object of the present invention is to provide a lighting fixture with an adjustable light pattern and a foldable house structure, which is an improved luminaire with adjustable light direction which utilize the fluorescent lamp and the rotatable reflector.

Another object of the present invention is to provide a lighting fixture with an adjustable light pattern and a foldable house structure, wherein the rotatable reflector is adapted for incorporating with a conventional light housing to selectively adjust the light pattern of the fluorescent lamp in the conventional light housing.

Another object of the present invention is to provide a lighting fixture with adjustable light beam to change the light pattern.

Another object of the present invention is to provide a lighting fixture with a foldable house structure, wherein the housing is adapted for being unfolded to retain the fluorescent lamps in position and is adapted for being folded into a compact size for storage and transportation.

Accordingly, in order to accomplish the above objects, the present invention provides a lighting fixture for fluorescent lamp, comprising:

a housing;

at least a fluorescent lamp longitudinally and operatively supported at the housing;

one or more lamp connectors rotatably and detachably mounting along the fluorescent lamp; and a reflector coupling with the lamp connectors, wherein the reflector is adapted to selectively rotate with respect to an axis of the fluorescent lamp for reflecting light from the fluorescent lamp so as to change a light pattern of the fluorescent lamp towards an opening of the housing.

The housing of the lighting fixture is embodied as a foldable housing which comprises two side frames and a retention frame extended between the two side frames to retain a distance between the side frames, wherein the side frames are pivotally coupled with the retention frame to fold between an unfolded position and a folded position. Accordingly, the fluorescent lamps are longitudinally and operatively supported at the foldable housing when the foldable housing is folded at the unfolded position.

These and other objectives, features, and advantages of the present invention will become apparent from the following detailed description, the accompanying drawings, and the appended claims.

DETAILED DESCRIPTION OF THE PREFERRED EMBODIMENT

Figure 1:
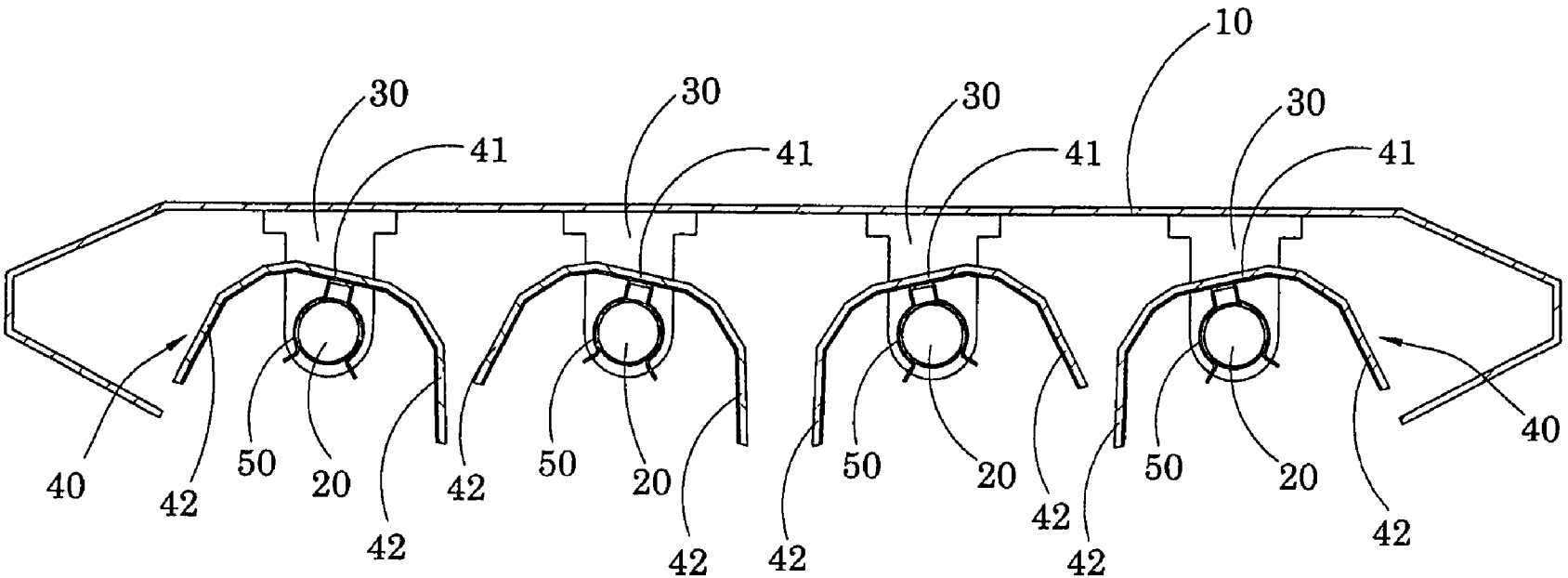
FIG. 1 is a sectional view of a lighting fixture with an adjustable the light pattern according to a preferred embodiment of the present invention.

Referring to FIGS. 1 to 5 of the drawings, a lighting fixture according to a preferred embodiment of the present invention is illustrated, wherein the lighting fixture comprises a housing 10, one or more fluorescent lamps 20, one or more lamp holders 30, one or more reflectors 40, and one or more lamp connectors 50.

The housing 10 receives all the elements for holding and protection. The lamp holder 30 is connected on the housing 10 and holds the fluorescent lamp 20 for supporting and providing power. In a housing 10 there could be one or more fluorescent lamps 20 supported by the corresponding holders. Preferably, these fluorescent lamps 20 are longitudinally supported and are aligned in parallel in the housing 10.

The reflector 40 is longitudinally extended along the fluorescent lamp 20 with the corresponding length as the fluorescent lamp 20. However, the reflector 40 can have a designed length extended along the fluorescent lamp 20 for light reflection. The reflector 40 has a concave shaped cross section, preferably a U-shaped cross section. The inner surface of the reflector 40 can reflect light. Therefore, the reflector 40 can cover the fluorescent lamp 20 and reflect the light to a focused direction. In a preferred embodiment, the reflector 40 comprises a back reflecting panel 41 and two slanted reflecting panels 42 inclinedly extended from the edge of the back reflecting panel 41 to make the cross section of the reflector 40 a concave shape. So when the reflector is over the fluorescent lamp 20, the back reflecting panel 41 and the slanted reflecting panels 42 can reflect the light of the lamp to change the light pattern and light direction towards a selected direction.

Figure 2:
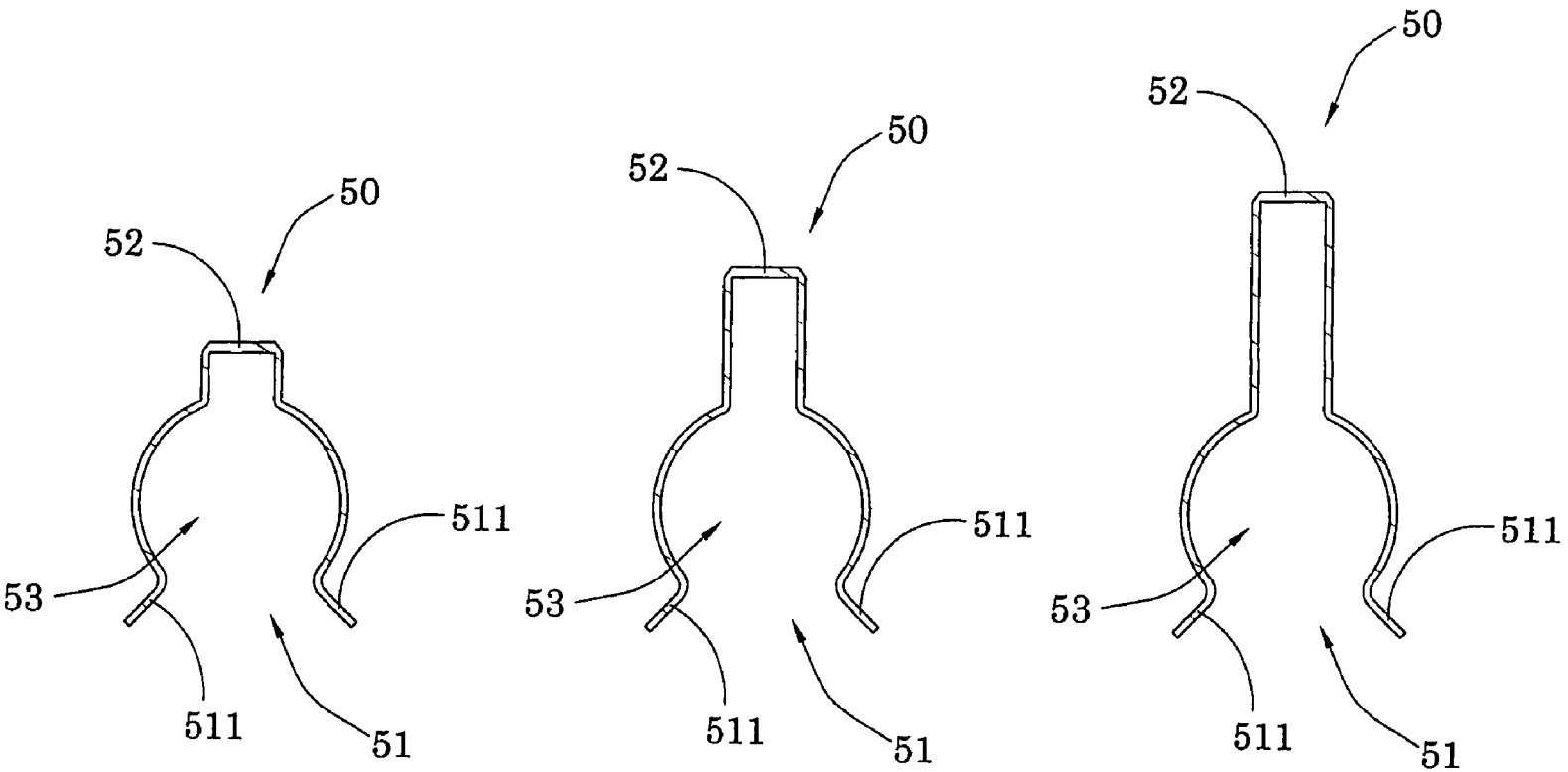
FIG. 2 is a sectional view of the lamp connector and its alternative modes according to the above preferred embodiment of the present invention.
Figure 3:
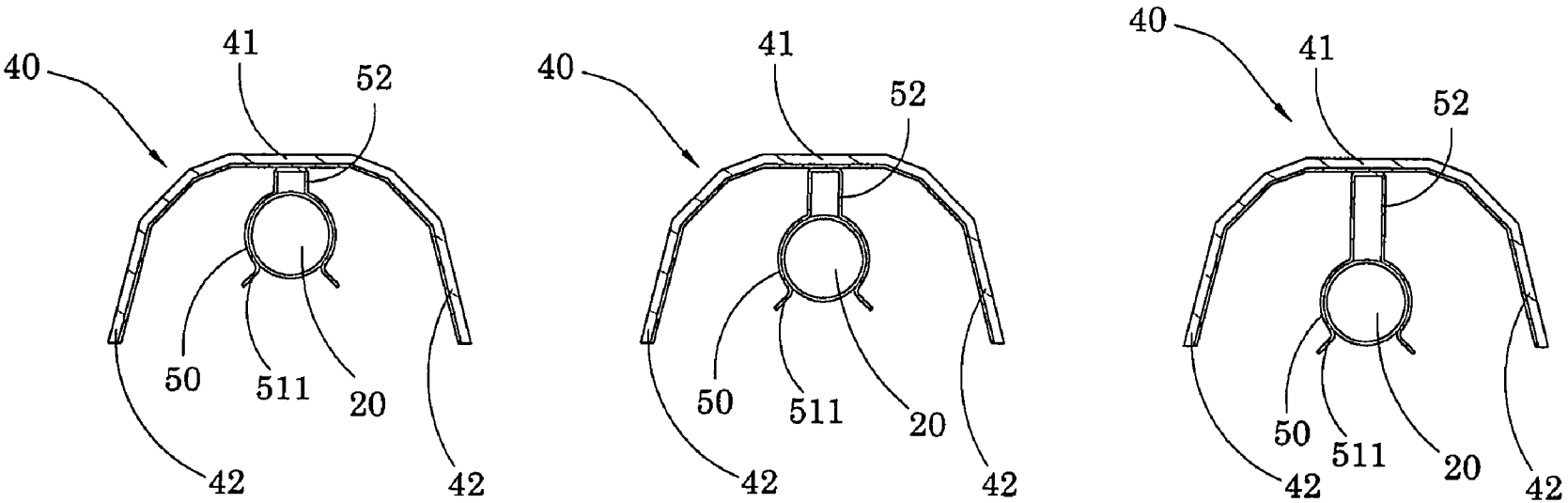
FIG. 3 is a sectional view illustrating the lamp connector and its alternative modes mounting to the fluorescent lamp according to the above preferred embodiment of the present invention.
Figure 6:
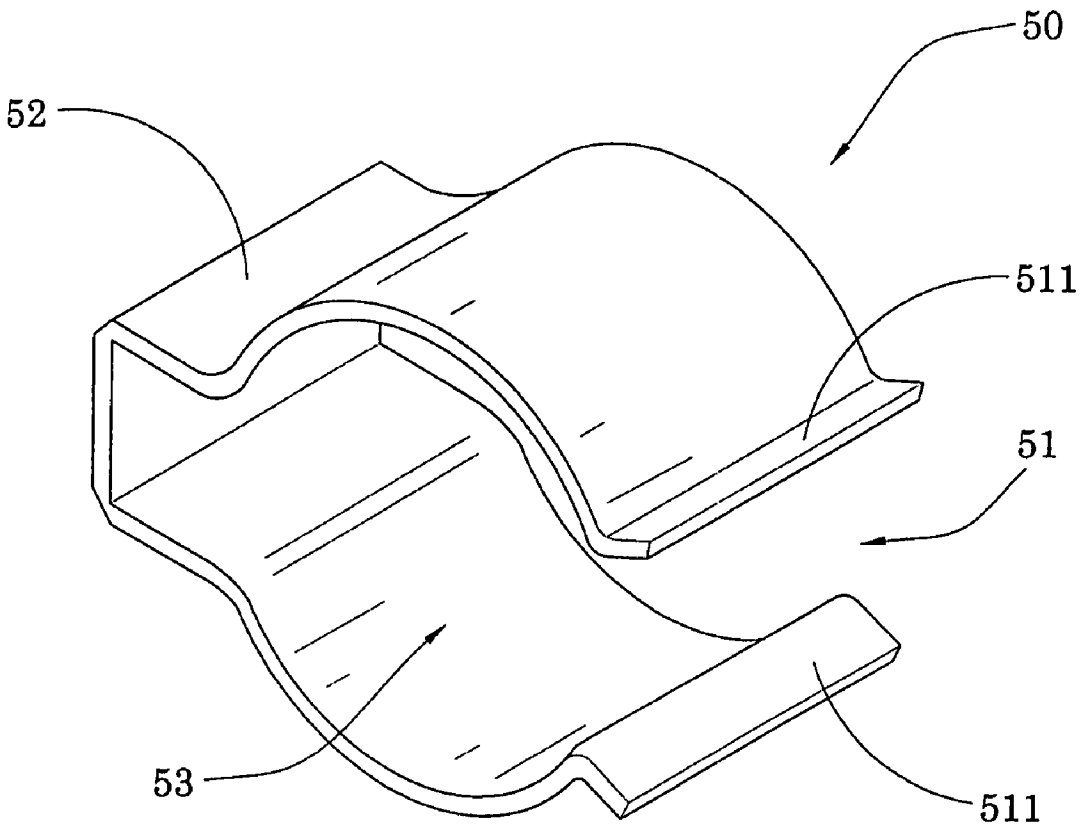
FIG. 6 is a perspective view of the lamp connector according to the above preferred embodiment of the present invention.

Referring to FIGS. 2, 3 and 6, the lamp connector 50 is made of flexible material. It comprises an open end 51 and a supporting end 52. Behind the open end 51, the lamp connector 50 comprises a receiving cavity 53 which has a C-shaped cross section and a similar size as the fluorescent lamp 20. The opening of the open end 51 is a little smaller than the diameter of the fluorescent lamp 20. The open end 51 also has two slanted opening edges 511 outwardly and opposedly extended thereat. The two slanted opening edges 511 provide a larger opening to receive the fluorescent lamp 20. The fluorescent lamp 20 can be inserted into the receiving cavity 53 from the open end 51 thereof, and be detachably connected by the lamp connector 50 by elastic force. In this way, the lamp connector 50 is pivotally attached on the fluorescent lamp 20, and can be rotated along the axis of the fluorescent lamp 20. According to the preferred embodiment, each of the lamp connectors 50 can be a lamp clip for detachably clipping on the fluorescent lamp 20.

The supporting end 52 of the lamp connector 50 is affixed to an inner surface of the reflector 40. According to the preferred embodiment, the supporting end 52 of the lamp connector 50 is affixed onto the inner surface of back reflecting panel 41 of the reflector 40 to support the reflector 40. It is appreciated that the supporting end 52 of the lamp connector 50 can be affixed to any of the reflecting panels 41, 42 to detachably couple the reflector 40 along the fluorescent lamp 20. Therefore the reflector 40 and the fluorescent lamp 20 are pivotally connected by the lamp connector 50. In the way, the reflector 40 can be rotated along the axis of the fluorescent lamp 20 to adjust the reflection of the light to a desired direction. Each reflector 40 may have one or more lamp connectors 50 to connect with the fluorescent lamp 20. Preferably, a reflector 40 has two lamp connectors 50 affixed at the two ends thereof. The lamp connectors 50 can be affixed onto the reflector 40 by screw, glue, or any other similar methods.

Referring to FIGS. 2 and 3, the supporting end 52 of the lamp connectors 50 has different heights. Therefore the fluorescent lamp 20 can be installed in the reflector 40 with different positions. This gives a flexibility to apply the present invention to be adjusted so as to have different light beam angles. In other words, the lamp connectors 50 are adapted to selectively configure a length between the open end 51 and the supporting end 52 in such a manner that when the fluorescent lamp 20 is coupled at the open end 51 of the lamp connector 50, a distance between the fluorescent lamp 20 and the reflector 40 is selectively adjusted corresponding to the length of the lamp connector 50.

Figure 4:
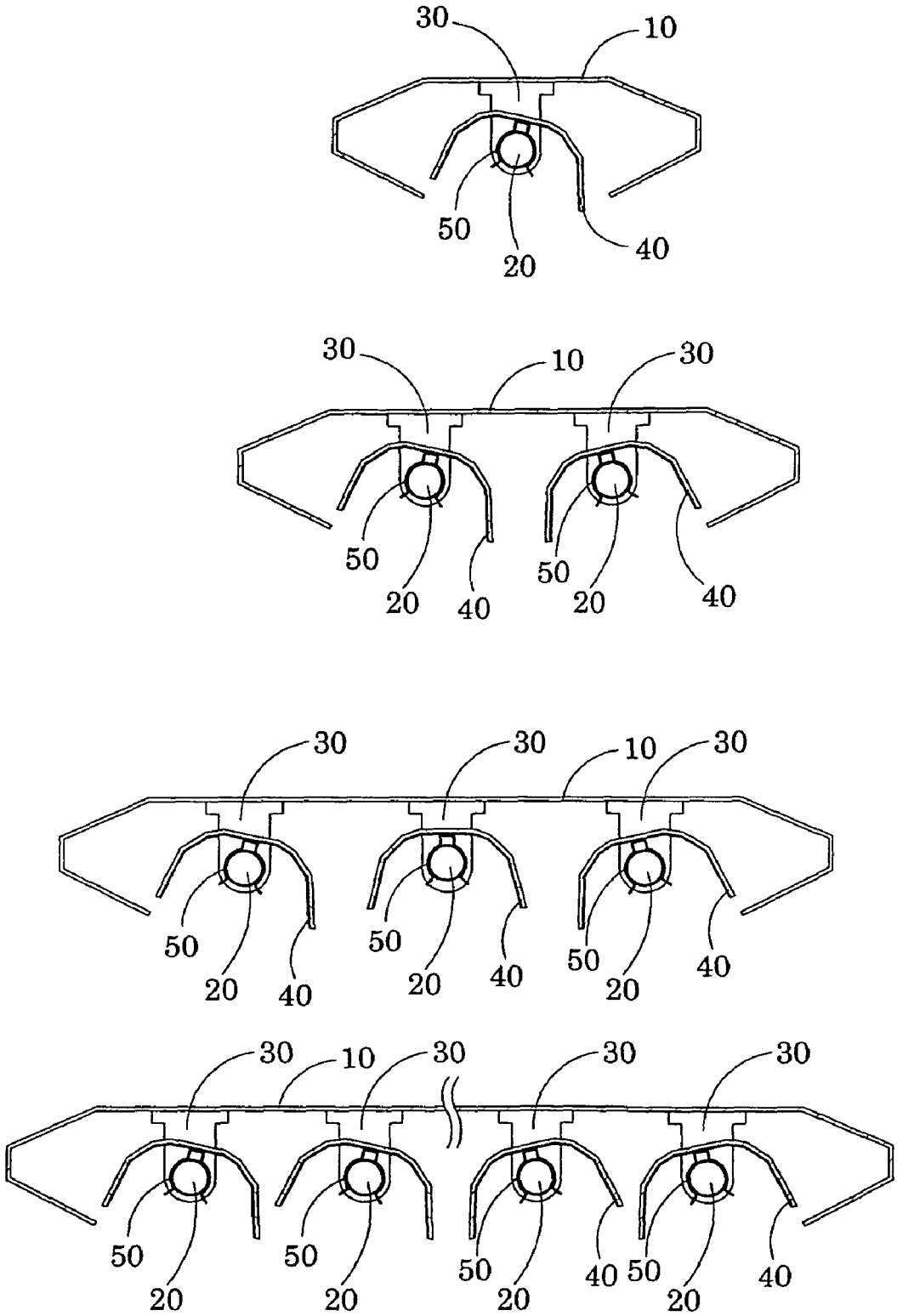
FIG. 4 illustrates the applications of the rotatable reflector for the lighting fixture according to the above preferred embodiment of the present invention.
Figure 5:
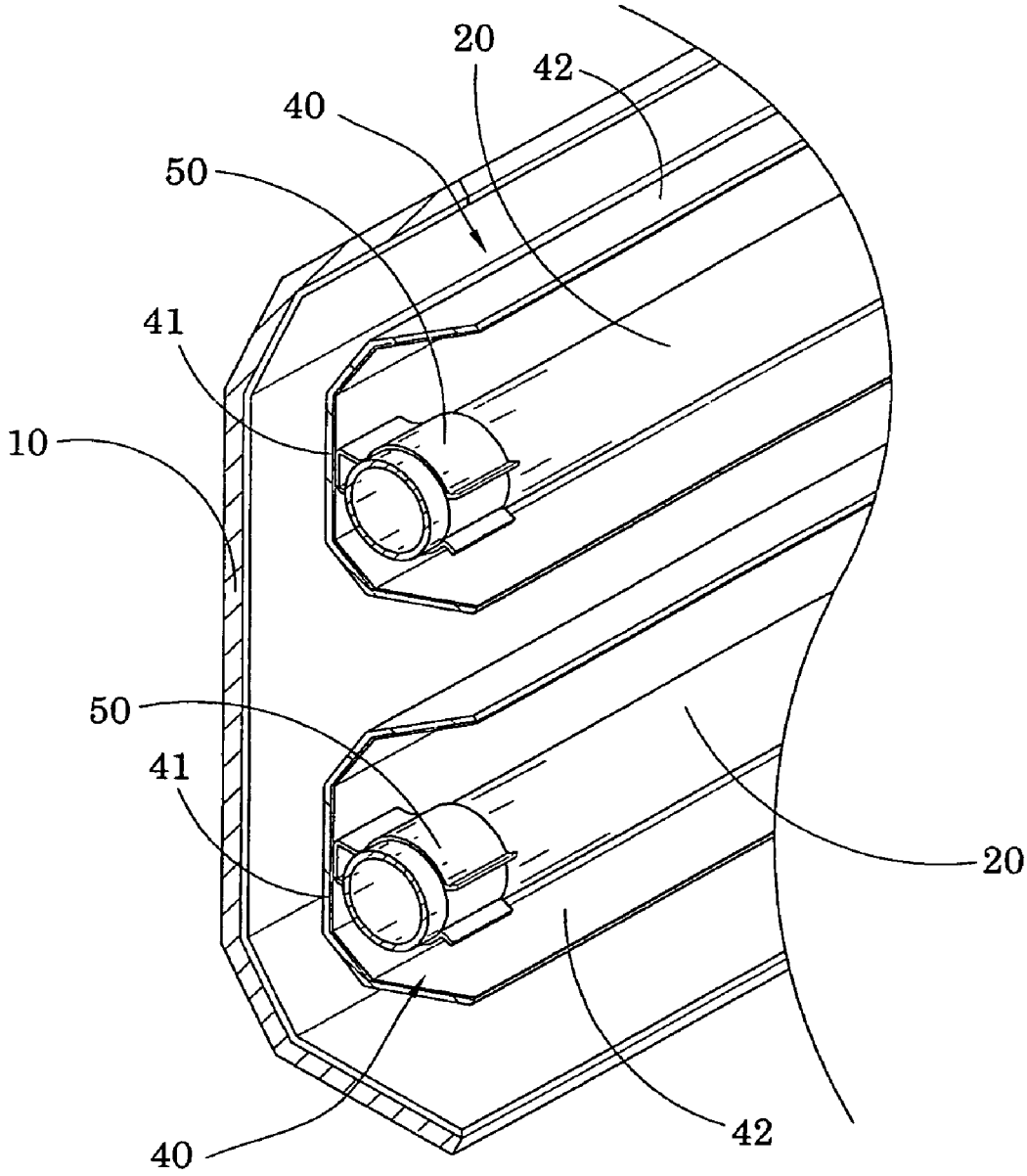
FIG. 5 is a perspective view of the lighting fixture according to the above preferred embodiment of the present invention.

Referring to FIGS. 4 and 5, in practice, the reflector 40 can be rotated over the fluorescent lamp 20 along the axis thereof to adjust the reflection direction. Therefore even the housing 10 and the fluorescent lamp 20 are affixed, the lighting direction can still be adjusted as will. If there are multiple lamps 20 in a housing 10, each reflector 40 of each fluorescent lamp 20 can be adjusted individually and provides more flexibility.

The present invention is very convenient to install and use. It is appreciated that the reflectors 40 can be detached from the fluorescent lamps 20 to be packed without the fluorescent lamps 20.

FIGS. 7 to 11 illustrate an alternative mode of the housing 10' as a foldable housing which is adapted to be folded between an unfolded position and a folded position. As shown in FIGS. 7 to 11, the housing 10' comprises two side frames 11' and a retention frame 12' extended between the side frames 11' to retain a distance between the side frames 11'. Accordingly, the distance between the side frames 11' should be retained to correspondingly match with the length of the fluorescent lamp 20.

The lamp holders 30 are spacedly provided along the inner sides of the side frames 11' in such a manner that two ends of each of the fluorescent lamp 20 are electrically coupled at two corresponding lamp holder 30 at the side frames 11' respectively when the housing 10' is folded at the unfolded position. Accordingly, the lamp holders 30 are a plurality of lamp sockets spacedly formed at the side frame 11' to electrically couple with the ends of the fluorescent lamps 20.

Figure 7:
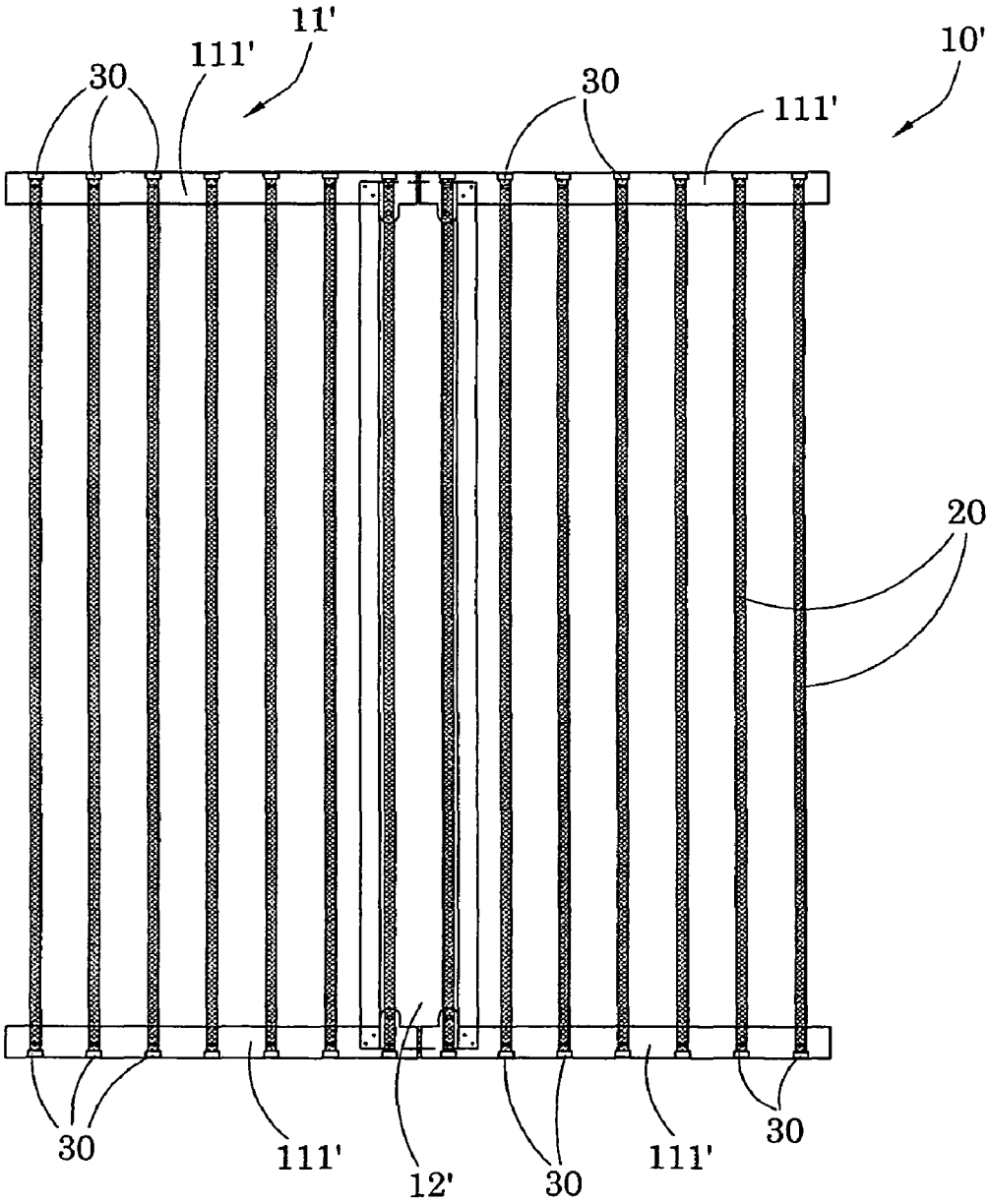
FIG. 7 is a top view of the lighting fixture according to the above preferred embodiment of the present invention, illustrating the foldable house structure of the light fixture.
Figure 8:
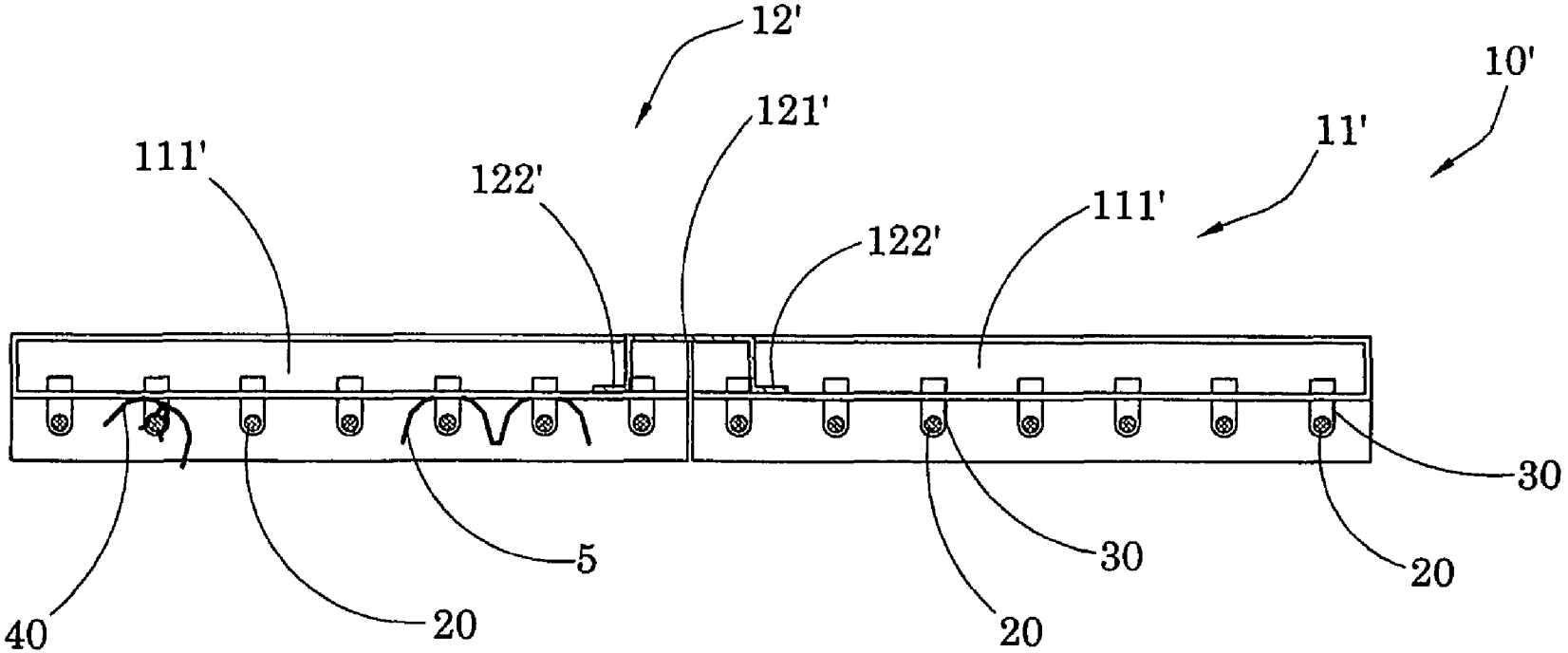
FIG. 8 is a sectional view of the lighting fixture with the foldable house structure according to the above preferred embodiment of the present invention.
Figure 9:
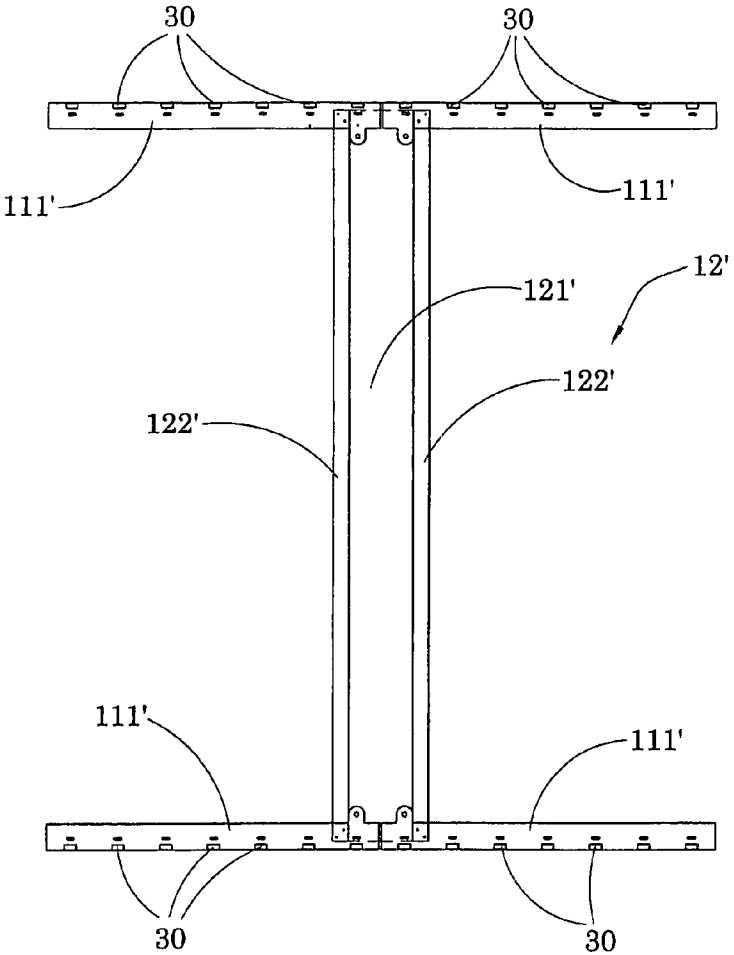
FIG. 9 is a top view of the foldable house structure of the lighting fixture according to the above preferred embodiment of the present invention.
Figure 11:
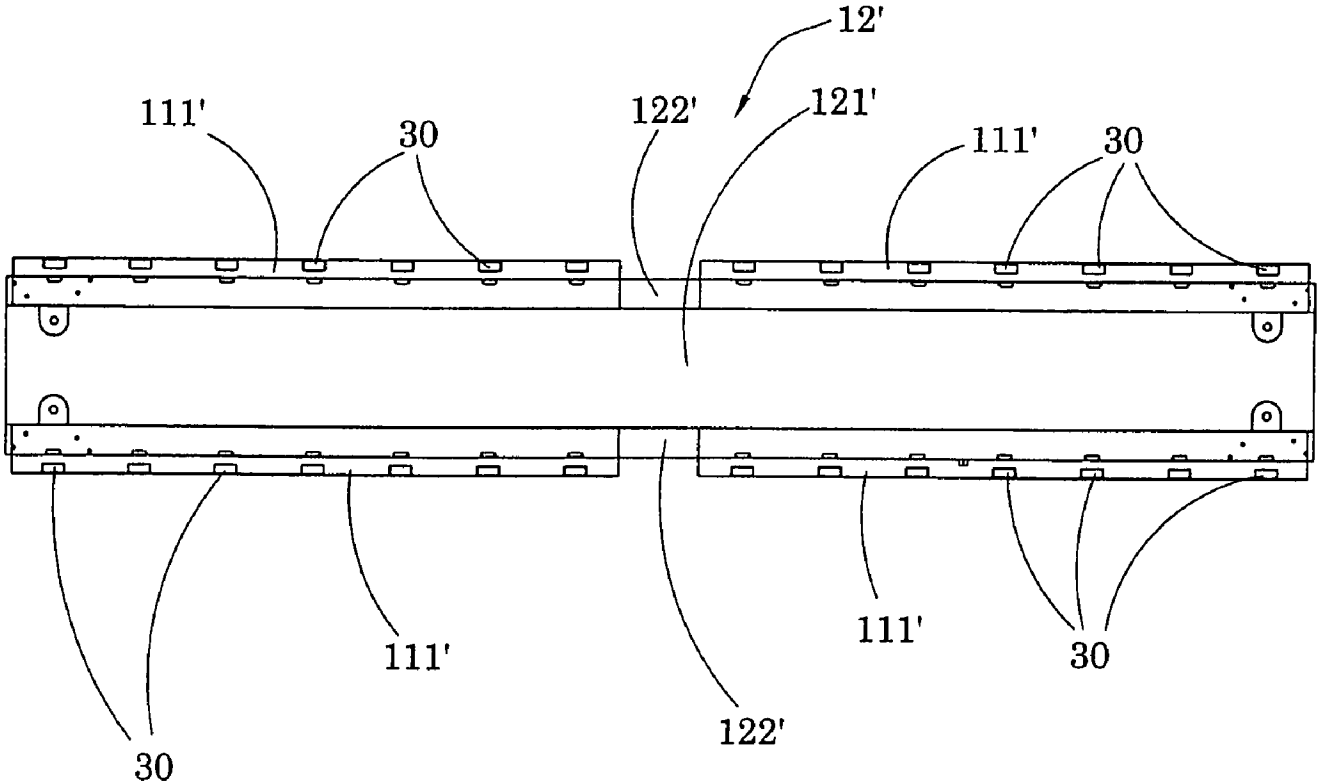
FIG. 11 is a top view of the foldable housing structure of the lighting fixture according to the above preferred embodiment of the present invention, illustrating the foldable housing structure being folded at a folded position.
Figure 12:
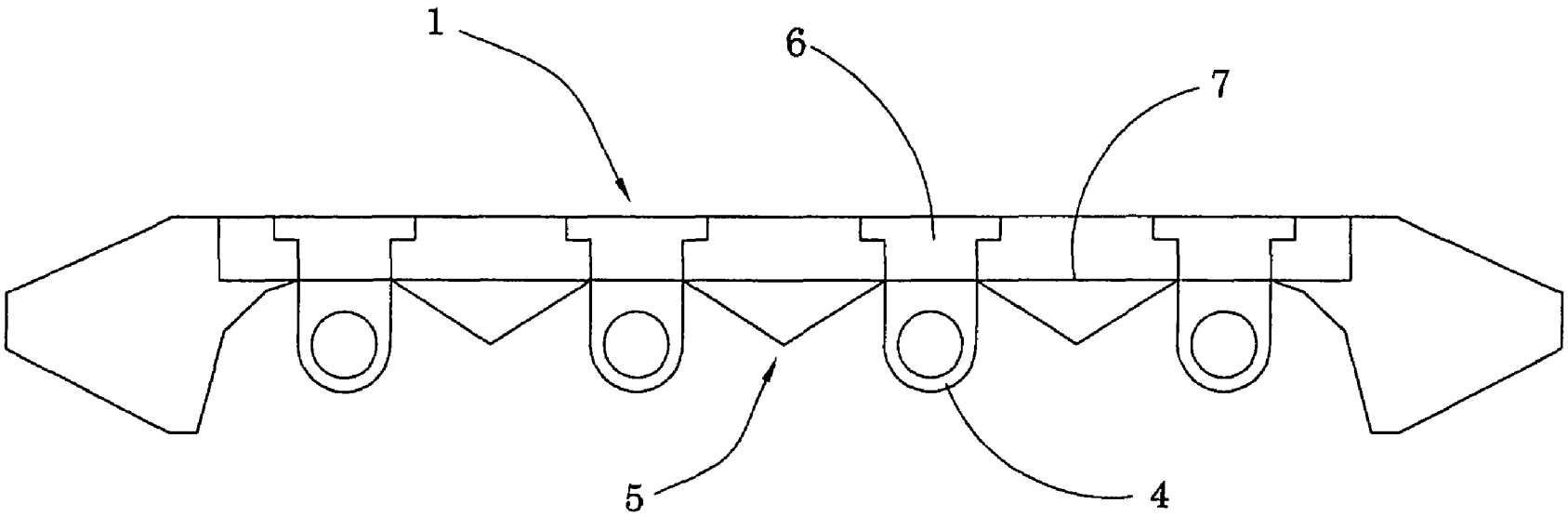
FIG.12 PRIOR ART
FIG. 12 illustrates a conventional reflector for the lighting fixture according to the above preferred embodiment of the present invention.

Each of the side frames 11' comprises two folding arms 111' pivotally coupling with the retention frame 12', wherein the folding arms 111' of each of the side frames 11' are pivotally folded between the unfolded position and folded position. As shown in FIGS. 7 and 9, at the unfolded position of each of the side frames 11', the two corresponding folding arms 111' are pivotally folded end-to-end to form an elongated structure. As shown in FIG. 11, at the folded position of each of the side frames 11', the two corresponding folding arms 111' are pivotally folded to overlap with the retention frame 12' such that the two folding arms 111' are parallel with each other. Preferably, the two folding arms 111' of each of the side frame 11' have the same length such that each of the side frames 11' can be pivotally folded in half to the retention frame 12' when the side frame 11' is pivotally folded at its folded position.

Figure 10:
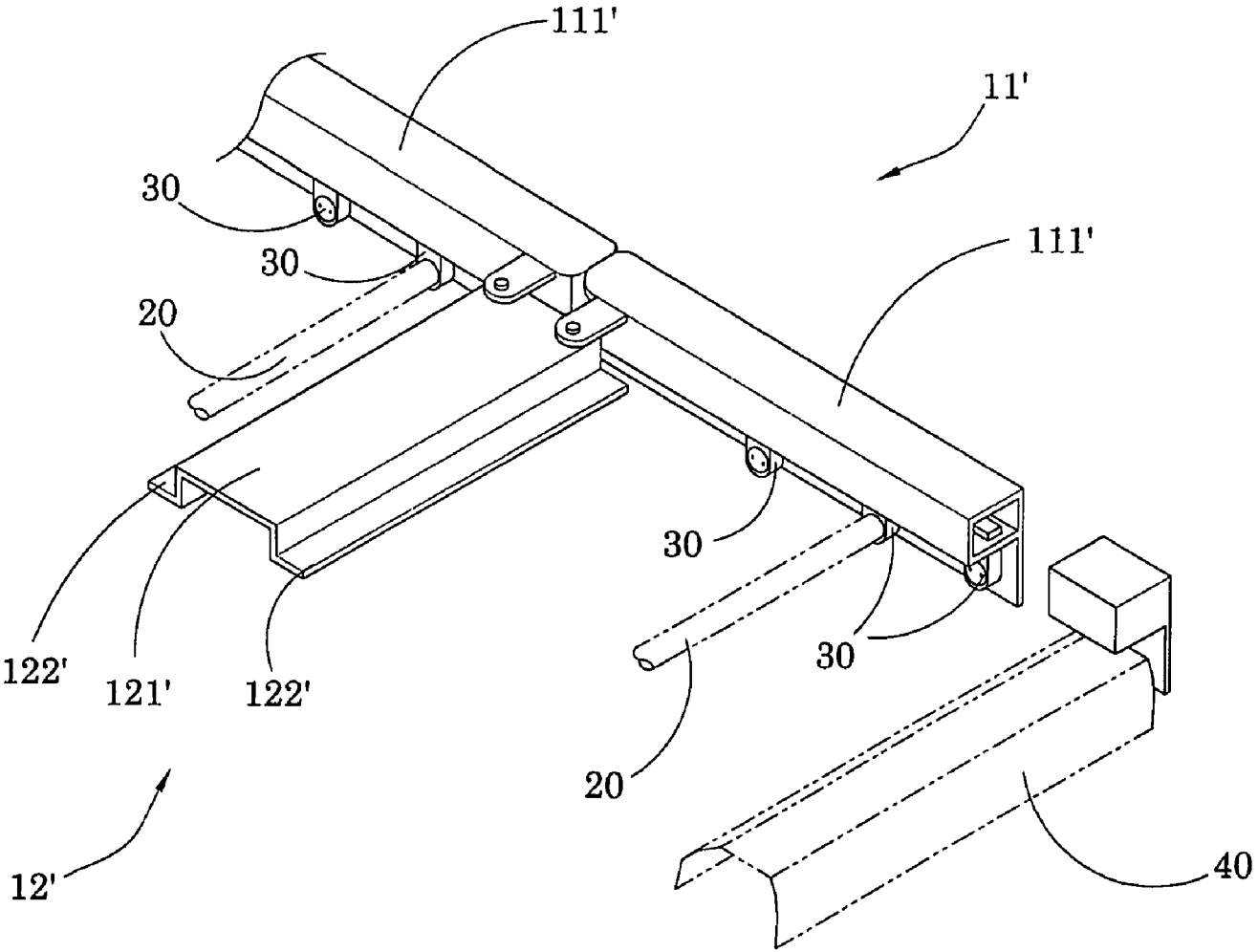
FIG. 10 is a partially perspective view of the foldable housing structure of the lighting fixture according to the above preferred embodiment of the present invention.

As shown in FIG. 10, the retention frame 12', preferably having an Omega "Ω" shaped cross section, defines an upper mid-portion 121' and two lower side-portions 122'. It is appreciated that the retention frame 12' can have a hollow rectangular cross section or a U-shaped cross section. The folding arms 111' of the side frames 11' are pivotally coupled at the top side of the mid-portion 121' of the retention frame 12' such that when each of the folding arms 111' is pivotally folded towards the retention frame 12', the folding arm 111' is folded to align with the respective side-portion 122' of the retention frame 12'. Therefore, the lamp holders 30 are enclosed and protected within the two corresponding folding arms 111' of the side frame 11' when the folding arms 111' are folded at the folded position.

It is worth to mention that when the housing 10' is pivotally folded at its unfolded position, the fluorescent lamps 20 are spacedly mounted between the side frames 11' to electrically couple with the lamp holders 30, wherein the reflectors 40 are detachably coupled with the fluorescent lamps 20 via the lamp connectors 50 at a position that each of the reflectors 40 is adapted to selectively rotate with respect to an axis of the respective fluorescent lamp 20 for reflecting light from the fluorescent lamp 20 so as to change a light pattern and/or a light direction of the fluorescent lamp 20 towards an opening of the housing 10'. In addition, the reflector 40 can be coupled with the fluorescent lamp 20 via the lamp connector 50 or can be directly coupled to the side frame 11' at a position between the folding arms 111' of the two side frames 11'. In other words, the housing 10' can also be incorporated with the conventional reflector 5.

When the reflectors 40 and the fluorescent lamps 20 are detached from the housing 10', the housing 10' is adapted to pivotally fold to its folded position to form a compact structure, such that the reflectors 40, the fluorescent lamps 20, the lamp connectors 50, and the folded housing 10' can be packed in a compact package for transportation purpose.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lighting fixture, comprising:

a foldable housing which comprises two side frames and a retention frame provided between said two side frames, wherein said side frames are pivotally coupled with said retention frame to fold between an unfolded position and a folded position;

at least a fluorescent lamp longitudinally and operatively supported at said foldable housing when said foldable housing is folded at said unfolded position;

at least a reflector coupling with said fluorescent lamps respectively for reflecting light from said fluorescent lamps towards an opening of said foldable housing; and a plurality of lamp connectors rotatably and detachably mounting along said fluorescent lamps, wherein each of said reflectors is coupling with at least one of said lamp connectors, such that each of said reflectors is adapted to selectively rotate with respect to an axis of said respective fluorescent lamp for reflecting light from said fluorescent lamp so as to change a light pattern of said fluorescent lamp towards an opening of said housing.

2. The lighting fixture, as recited in claim 1, wherein each of said lamp connectors has an open end for receiving said fluorescent lamp, a receiving cavity for encirclingly holding said fluorescent lamp in a rotatable manner, and a supporting end detachably connected with said reflector for supporting said reflector behind said fluorescent lamp.

3. The lighting fixture, as recited in claim 2, wherein each of said lamp connectors has an open end for receiving said fluorescent lamp, a receiving cavity for encirclingly holding said fluorescent lamp in a rotatable manner, and a supporting end detachably connected with said reflector for supporting said reflector behind said fluorescent lamp.

4. The lighting fixture, as recited in claim 3, wherein said receiving cavity has a C-shaped cross section and a size slightly smaller than a circumferential size of said fluorescent lamp, wherein said lamp connectors are adapted to selectively configure a length between said open end and said supporting end in such a manner that when said fluorescent lamp is coupled at said open end of said lamp connector, a distance between said fluorescent lamp and said reflector is selectively adjusted corresponding to the length of said lamp connector.

5. The lighting fixture, as recited in claim 4, wherein each of said lamp connectors further has two slanted opening edges outwardly and opposedly extended at said open end of said lamp connector for said fluorescent lamp sliding into said receiving cavity of said lamp connector.

6. The lighting fixture, as recited in claim 2, wherein said receiving cavity has a C-shaped cross section and a size slightly smaller than a circumferential size of said fluorescent lamp, wherein said lamp connectors are adapted to selectively configure a length between said open end and said supporting end in such a manner that when said fluorescent lamp is coupled at said open end of said lamp connector, a distance between said fluorescent lamp and said reflector is selectively adjusted corresponding to the length of said lamp connector.

7. The lighting fixture, as recited in claim 2, wherein each of said lamp connectors further has two slanted opening edges outwardly and opposedly extended at said open end of said lamp connector for said fluorescent lamp sliding into said receiving cavity of said lamp connector.

8. The lighting fixture, as recited in claim 7, wherein each of said lamp connectors is made of flexible material to hold said fluorescent lamp by elastic force.

9. The lighting fixture, as recited in claim 1, wherein each of said reflectors comprises a back reflecting panel coupling with said lamp connector to support behind said fluorescent lamp and two slanted reflecting panels inclinedly extended along two side edges of said back reflecting panel respectively in such a manner that when said reflector is selectively rotated with respect to said axis of said fluorescent lamp, said back reflecting panel and said slanted reflecting panels of said reflector are adapted for reflecting said light to change said light pattern of said fluorescent lamp to said opening said housing.

10. A lighting fixture, comprising:

a foldable housing which comprises two side frames and a retention frame provided between said two side frames, wherein said side frames are pivotally coupled with said retention frame to fold between an unfolded position and a folded position;

at least a fluorescent lamp longitudinally and operatively supported at said foldable housing when said foldable housing is folded at said unfolded position, wherein said retention frame is extended between said two side frames to retain a distance between said side frames, wherein each of said side frames comprises two folding arms pivotally coupling with said retention frame, wherein said folding arms of each of said side frames are pivotally folded between said unfolded position and said folded position, that at said unfolded position, said two corresponding folding arms are pivotally folded end-to-end to form an elongated structure, and at said folded position said two corresponding folding arms are pivotally folded to overlap with said retention frame such that said two folding arms are parallel with each other;

at least a reflector coupling with said fluorescent lamps respectively for reflecting light from said fluorescent lamps towards an opening of said foldable housing; and a plurality of lamp connectors rotatably and detachably mounting along said fluorescent lamps, wherein each of said reflectors is coupling with at least one of said lamp connectors, such that each of said reflectors is adapted to selectively rotate with respect to an axis of said respective fluorescent lamp for reflecting light from said fluorescent lamp so as to change a light pattern of said fluorescent lamp towards an opening of said housing.

11. The lighting fixture, as recited in claim 10, wherein each of said lamp connectors has an open end for receiving said fluorescent lamp, a receiving cavity for encirclingly holding said fluorescent lamp in a rotatable manner, and a supporting end detachably connected with said reflector for supporting said reflector behind said fluorescent lamp.

12. A lighting fixture, comprising:

a foldable housing which comprises two side frames and a retention frame provided between said two side frames, wherein said side frames are pivotally coupled with said retention frame to fold between an unfolded position and a folded position;

at least a fluorescent lamp longitudinally and operatively supported at said foldable housing when said foldable housing is folded at said unfolded position, wherein said retention frame is extended between said two side frames to retain a distance between said side frames, wherein each of said side frames comprises two folding arms pivotally coupling with said retention frame, wherein said folding arms of each of said side frames are pivotally folded between said unfolded position and said folded position, that at said unfolded position, said two corresponding folding arms are pivotally folded end-to-end to form an elongated structure, and at said folded position, said two corresponding folding arms are pivotally folded to overlap with said retention frame such that said two folding arms are parallel with each other;

a plurality of lamp holders spacedly provided along inner sides of said side frames, wherein two ends of each of said fluorescent lamp are electrically coupled at said two corresponding lamp holder at said side frames respectively when said foldable housing is folded at said unfolded position;

at least a reflector coupling with said fluorescent lamps respectively for reflecting light from said fluorescent lamps towards an opening of said foldable housing; and a plurality of lamp connectors rotatably and detachably mounting along said fluorescent lamps, wherein each of said reflectors is coupling with at least one of said lamp connectors, such that each of said reflectors is adapted to selectively rotate with respect to an axis of said respective fluorescent lamp for reflecting light from said fluorescent lamp so as to change a light pattern of said fluorescent lamp towards an opening of said housing.

13. The lighting fixture, as recited in claim 12, wherein each of said lamp connectors has an open end for receiving said fluorescent lamp, a receiving cavity for encirclingly holding said fluorescent lamp in a rotatable manner, and a supporting end detachably connected with said reflector for supporting said reflector behind said fluorescent lamp.

14. A lighting fixture, comprising:

a foldable housing which comprises two side frames and a retention frame provided between said two side frames, wherein said side frames are pivotally coupled with said retention frame to fold between an unfolded position and a folded position;

at least a fluorescent lamp longitudinally and operatively supported at said foldable housing when said foldable housing is folded at said unfolded position;

at least a reflector coupling with said fluorescent lamps respectively for reflecting light from said fluorescent lamps towards an opening of said foldable housing; and a plurality of lamp connectors mounting along said fluorescent lamps;

wherein each of said reflectors comprises a back reflecting panel coupling with said lamp connector to support behind said fluorescent lamp and two slanted reflecting panels inclinedly extended along two side edges of said back reflecting panel respectively in such a manner that when said reflector is selectively rotated with respect to said axis of said fluorescent lamp, said back reflecting panel and said slanted reflecting panels of said reflector are adapted for reflecting said light to change said light pattern of said fluorescent lamp to said opening said housing.

* * * * *